US006092351A

United States Patent [19]

Imkamp et al.

[11] Patent Number: 6,092,351

[45] Date of Patent: Jul. 25, 2000

[54] METHOD AND DEVICE FOR BONDING POURERS TO FLAT-TOPPED PARALLELEPIDAL CARTONS FILLED WITH FREE-FLOWING PRODUCTS

[75] Inventors: Thomas Imkamp, Dusseldorf; Hans Peter Lonzen, Eschweiler, both of Germany; Peter Meyer, Beringen, Switzerland

[73] Assignee: SIG Combibloc, GmbH, Germany

[21] Appl. No.: 09/011,168

[22] PCT Filed: Jul. 27, 1996

[86] PCT No.: PCT/EP96/03322

§ 371 Date: Apr. 14, 1998

§ 102(e) Date: Apr. 14, 1998

[87] PCT Pub. No.: WO97/04953

PCT Pub. Date: Feb. 13, 1997

[30] Foreign Application Priority Data

Aug. 2, 1995 [DE] Germany ..... 195 28 367

[51] Int. Cl.[7] ..... B65B 61/18

[52] U.S. Cl. ..... 53/412; 53/69; 53/72; 53/133.2; 53/133.4; 53/410; 493/87

[58] Field of Search ..... 156/69; 493/8, 493/12, 27, 29, 87, 102, 213, 214; 53/64, 67, 69, 72, 410, 412, 133.1, 133.2, 133.3, 133.4

[56] References Cited

U.S. PATENT DOCUMENTS

| | | | |
|---|---|---|---|
| 4,507,168 | 3/1985 | Konaka | 493/133 X |
| 4,788,811 | 12/1988 | Kawajiri et al. | 493/87 X |
| 4,990,200 | 2/1991 | Heinz | 53/485 X |
| 5,219,320 | 6/1993 | Abrams et al. | 493/87 X |
| 5,297,375 | 3/1994 | Reil et al. | 53/133.2 X |
| 5,304,265 | 4/1994 | Keeler | 156/64 |
| 5,429,699 | 7/1995 | Abrams et al. | 493/87 X |
| 5,447,007 | 9/1995 | Reil et al. | 53/133.2 |
| 5,473,857 | 12/1995 | Keeler | 53/133.2 X |
| 5,484,374 | 1/1996 | Bachner et al. | 53/133.2 X |
| 5,716,471 | 2/1998 | Pape | 53/410 X |

FOREIGN PATENT DOCUMENTS

| | | |
|---|---|---|
| 0 513 439 | 11/1992 | European Pat. Off. . |
| 4-112030 | 8/1992 | Japan . |

*Primary Examiner*—Daniel B. Moon
*Attorney, Agent, or Firm*—Standley & Gilcrest LLP

[57] ABSTRACT

The invention relates to a method of applying pouring elements to flat-gabled packages filled with free-flowing products, where the pouring elements are glued to the individually conveyed and sealed packages, where a fully automatic application operation is possible, where trouble due to improper positioning and incomplete gluing of the pouring elements is reliably prevented. In addition, it is desirable to prevent packages not having the pouring elements attached to them from leaving the gluing station. This is accomplished by the following steps: horizontal conveyance of successively arranged packages standing upright, separation of the packages and introduction of the separated packages into a gluing station depending on the presence of a pouring element, applying adhesive to the pouring element and gluing and pressing the pouring element to a predetermined area of each package.

16 Claims, 5 Drawing Sheets

METHOD AND DEVICE FOR BONDING POURERS TO FLAT-TOPPED PARALLELEPIDAL CARTONS FILLED WITH FREE-FLOWING PRODUCTS

The invention relates to a method of applying pouring elements to cuboid flat-gabled packages filled with free-flowing products, where the pouring elements are glued to the individually supplied and sealed packages and an apparatus suitable for [carrying out this method], having feed equipment for conveying the packages and the pouring elements and having a gluing station.

Cuboid flat-gabled packages are known especially as retail units for beverages in general. Depending on the size and contents of these packages, there is a need for providing such packages with reclosable pour spouts. On the one hand, this is for hygiene reasons, and on the other hand it is also done to make it possible to keep the contents fresh for a longer period of time and also prevent any loss of taste or aroma, A previously described flat-gabled package having such a reclosable pour spout is known, for example, from European Patent 332,800 B1 or WO 92/18394. With the previously known packages, the pouring element is applied to the package which has already been filled and sealed, so the top side of the package has a perforation in the laminated material to facilitate the penetration of the opening part of the pouring element in the actual operation of opening the package. To do so, the pouring element must be applied to the top side of the package exactly above the perforation.

It can be seen readily that gluing the pouring elements to the packages must be done very carefully to maintain the exact position as well as achieve a reliable bonding so that the pouring element will not pull away from the package and thus the desired freedom from leaks is also guaranteed after opening the package.

Therefore, the object of the invention is to embody and improve on the method defined initially and the corresponding apparatus so that fully automatic application operation is possible, while reliably preventing problems due to improper positioning and incomplete gluing of the pouring elements. In addition, it is desirable to prevent packages from leaving the gluing station without the pouring element sealed in place.

This object ia achieved with the following steps with regard to the method according to the definition of the species of claim 1:

- horizontal conveyance of a succession of upright packages,
- isolation of the packages and introducing the isolated packages into a gluing station, depending on the presence of a pouring element,
- applying adhesive to the pouring element, and
- gluing and pressing the pouring element to a predetermined area of each package.

The horizontally conveyed packages are preferably arranged in succession in the longitudinal direction. Hot-melt adhesive is preferably used for gluing the pouring elements.

With regard to the respective apparatus, the object on which this invention is based is achieved by the fact that a conveyor chain moving horizontally is used to guide the packages at the bottoms; a separator isolates the packages, and an entraining element with a number of driving elements is provided for conveying the isolated packages; a carrying chain with a number of carriers for the pouring elements is arranged above the entraining element, with the spacing between the carriers corresponding to the spacing between the driving elements arranged on the entraining element; the gluing station has an applicator element for applying the adhesive, and a detector is provided for detecting the proper presence of a pouring element in the pouring element carriers conveyed to the gluing station.

Thus, according to this invention, a package is always cycled into the entraining chain when a pouring element is "waiting" in the transfer position. This reliably ensures that a package also leaves the gluing station with a properly applied pouring element. The packages leaving the gluing station can thus be packaged fully automatically without sorting out packages that do not have a pouring element. There cannot be unintentional disturbances in operation due to downtime for cleaning up excessive or improperly applied hot-melt adhesive due to the fact that the metered amount of hot-melt adhesive is always correct due to the method according to this invention and the apparatus according to this invention.

In another embodiment of the invention, the separator has a brake unit for stopping the conveyed packages on the moving conveyor chain and an acceleration unit for accelerating the conveyed packages on the moving conveyor belt. This has the advantage that the conveyor chain which supports the packages at the bottom can continue to run at the same speed so that further conveyance of the packages toward the front on the conveyor chain in the apparatus is guaranteed even when the brake unit is operated. At least two conveyor belts that act on the side walls of several adjacent packages can be provided as the brake unit. The brake unit thus not only has the function of braking the packages but also serves as a side guide. Due to the embodiment with conveyor belts, when the brake is not operated, it also serves as a conveyance device that can be driven at the same rate of conveyance as the conveyor chain to provide gentle conveyance of the packages.

According to another teaching of the invention, a pair of vertically arranged separating rolls is provided as the acceleration unit. In this way, it is possible at a low construction expense to accelerate the neighboring packages on the conveyor chain to the conveyance speed of the entraining element and thus separate them.

According to this invention, at least one entraining belt with forced feed of the packages at the back faces by means of entraining elements designed as entraining fingers is also provided as the entraining element. It is clear that an entraining chain or similar device may also be used within the scope of this invention.

It is especially expedient if the conveyance speed of the entraining element is greater than the conveyance speed of the conveyor chain and if the conveyance speed of the acceleration unit is greater than the conveyance speed of the brake unit. Therefore, the brake unit need be activated only when no pouring element is being supplied.

As mentioned previously, the pouring elements conveyed individually and taken up by the pouring element carriers with their bottom side (=adhesive side) facing up are conveyed to the packages from above in the gluing station.

In another embodiment of the invention, each pouring element carrier has two clamps that can be spread apart against a spring force to hold and release the pouring element. In addition, each pouring element carrier may have at least one pressure element for pressing the pouring element onto the top side of the package to permit gentle pressing of the pouring element against the package—already sealed and therefore flexible—immediately after application even before the release of the pouring element.

The pouring elements coming from the known isolation and aligning unit are not coated with the proper amount of adhesive until shortly before being brought in contact [with the package]. According to another teaching of this invention, a known applicator roll is used for this purpose.

It is also expedient if the separator, the entraining element and the conveyor chain or carrying chain are designed to be adjustable in their geometric dimensions to be able to glue the pouring elements onto packages of different sizes. Thus, with a single apparatus according to this invention, numerous different package sizes can be provided with pouring elements. It is especially advantageous here if two entraining belts which are arranged one above it other and are designed to be adjustable in height relative to each other are used as the entraining element.

Finally, another teaching of this invention provides for the individual treatment units through which the packages pass to be arranged in a straight line one after the other. In this way, the apparatus according to this invention can be especially small and can optionally also be used with filling machines with multiple parallel packaging lines directly side by side with other apparatuses of the same type.

The invention is described in greater detail below with reference to the drawing which illustrate only one embodiment. In the drawing shows FIG. 1: a side view of an apparatus according to this invention;

FIG. 2: a top view of the apparatus according to this invention;

FIG. 3: a detailed view of the apparatus according to this invention from FIG. 2;

FIG. 4: a detailed view of the separator of the apparatus according to this invention, consisting of the brake unit and the acceleration unit;

FIG. 5: a cross-sectional view of a pouring element carrier of the apparatus according to this invention;

FIG. 6: a sectional view along line VI—VI of the pouring element carrier from FIG. 5; and FIG. 7: a preferred driving diagram of the apparatus according to this invention.

FIGS. 1 and 2 show the general design of the apparatus according to this invention. Packages 1 are conveyed on a conveyor chain 2 to a separator 3 consisting of a brake unit 4 and an acceleration unit 5.

Brake unit 4 consists essentially of conveyor belts 6, which are guided essentially around rolls and come in contact with the packages 1 from both sides, and the acceleration unit 5 consisting of two vertically arranged pairs 7 of separation rolls adapted to the width of the package. The exact arrangement of the separator 3 is described again in detail in FIG. 4. It can be seen there that the packages 1 are supported with supporting plates (not shown) in the area of conveyor belts 6 between their rolls.

The actual treatment sequence can be described best on the basis of FIG. 3, where packages 1-1 to 1-6 from the brake unit 4 are shown in the "stopped" position on conveyor chain 2 which is moving in the direction of the arrow. Then when a package 1-7 leaves brake unit 4, it is accelerated by the separating rolls 7 so that it is conveyed into the proper position within two entraining fingers 9 in the area of the entraining belts 8 (shown here in mirror image). In the embodiment shown in FIG. 3, which is preferred in this regard, the driving rolls of the conveyor belts 6 and those of the separating rolls 7 are connected together effectively by means of intermeshing gearwheels (not shown in detail). The greater peripheral speed of the separating rolls 7 in comparison with the conveyor belt rolls which is necessary to achieve the separation effect is achieved by a larger outside diameter of separating rolls 7 accordingly. The spacing between the entraining fingers 9 corresponds exactly to the spacing between two adjacent pouring element carriers (not shown in FIGS. 1 through 3), which are described in greater detail below.

FIG. 1 also shows that a carrying chain 10, to which the above-mentioned pouring element carriers (not shown here) are attached, is arranged above the entraining belts 8 in the gluing station. They serve to hold and convey pouring elements 11, which are just indicated here and are conveyed to the pouring element carriers by a rail-like pouring element conveyance 12 from a separating and aligning unit 13, which is known and therefore merely indicated, to the correct position. Pouring elements 11 are then coated with the required amount of adhesive from an adhesive supply 15 by an applicator roll 14, which is also known, and glued to the packages 1 in the proper position.

FIGS. 5 and 6 show the pouring element carriers with the drawing references 16 in detail. The pouring elements 11 are held by spreading clamps 18 which act against the force of a spring 17, where the spreading clamps 18 are operated by a pressure element 20 which is also springloaded and is operated by a roll 19. Pouring element carrier 16 is lowered by a roll 19*a* which is rigidly connected to it. Pouring element carriers 16 are movably attached to carrying chain 10 by means of bolts (not shown) through two boreholes 21.

For gluing to packages 1, pouring elements 11 are pressed against the top side of packages 1 by a pressure pin 22 which is present in each pouring element carrier 16, and the spreading clamps 18 are spread apart to release the pouring elements 11. Pressure pins 22 are also spring-loaded, and they are also activated by a pressure element 24 activated by a roll 23.

Finally, FIG. 7 shows a preferred drive diagram which shows that the speed of conveyance of the separating rolls 7 which form the acceleration unit 5 is greater than the conveyance speed of the conveyor belts which form brake unit 4 and are driven by the same drive 25.

We claim:

1. A method of machine application of pouring elements to flat-gabled packages filled with free-flowing products, where the pouring elements are glued to individually conveyed and sealed packages, said method comprising the steps of:

horizontally conveying a successive arrangement of packages in an upright orientation;

isolating said packages by braking and then accelerating said packages;

introducing said isolated packages into an application station adapted to move along the conveyance path if a pouring element is present;

applying an adhesive to said pouring element; and gluing and pressing said pouring element to a predetermined area of each package, while said package continues to move along said conveyance path.

2. The method of claim 1, wherein said horizontally conveyed packages are successively arranged in a longitudinal direction.

3. The method of claim 1, wherein said adhesive is of a hot-melt variety.

4. A device for applying pouring elements to flat-gabled packages filled with free-flowing products, said device comprising:

a horizontally moving conveyor chain for guiding said packages;

a separator for isolating said packages;

an entraining element having a number of spaced driving elements for conveying said isolated packages;

a carrying chain disposed above said entraining element a number of spaced pouring element carriers attached to said carrying chain, the spacing of said pouring element carriers on said carrying chain corresponding to the spacing between said driving elements on said entraining element, said pouring element carriers adapted to apply said pouring elements to said packages while said packages remain in motion on said entraining element; and a gluing station having a detector for determining the presence of a pouring element within any of said pouring element carriers, and an applicator for applying an adhesive to said pouring element if present.

5. The device of claim 4, further comprising a brake unit for stopping the conveyed packages on the moving conveyor chain, and an acceleration unit for accelerating said conveyed packages on the moving conveyor chain.

6. The device of claim 5, wherein said brake unit comprises at least two conveyor belts for acting on the side walls of several adjacent packages.

7. The device of claim 5, wherein said acceleration unit comprises at least one pair of vertically arranged separating rolls.

8. The device of claim 5, wherein the conveyance speed of said acceleration unit is greater than the conveyance speed of said brake unit.

9. The device of claim 5 wherein said brake unit, said acceleration unit and said entraining element are arranged in a straight line.

10. The device of claim 4, wherein said entraining element comprises at least one belt having driving elements comprising projecting fingers, said fingers designed to convey said packages by contact with said package rear sides.

11. The device of claim 4, wherein the conveyance speed of said entraining element is greater than the conveyance speed of said conveyor chain.

12. The device of claim 4 wherein each pouring element carrier has at least two clamps that can be spread against a spring force to hold and release said pouring element.

13. The device of claim 4 wherein each pouring element carrier has at least one pressure element for pressing the pouring element against the top of said package.

14. The device of claim 4 wherein an applicator roll is provided for applying an adhesive to said pouring elements.

15. The device of claim 4 wherein said separator, said entraining element, and said conveyor chain or said carrying chain are adjustable, so that said device can apply pouring elements to packages of different size.

16. The device of claim 4 wherein said entraining element comprises two belts arranged one above the other, said belts designed to be adjustable in height relative to one another.

* * * * *

UNITED STATES PATENT AND TRADEMARK OFFICE

CERTIFICATE OF CORRECTION

PATENT NO. : 6,092,351 
DATED : July 25, 2000
INVENTOR(S) : Thomas Imkamp, Hans Peter Lonzen and Peter Meyer It is certified that error appears in the above-identified patent and that said Letters Patent is hereby corrected as shown below:

The entire specification, claims and abstract should be deleted and the substitute specification, claims and abstract be replaced therewith as shown in the attached pages.

Signed and Sealed this

Twenty-second Day of October, 2002

*Attest:*

*Attesting Officer*

JAMES E. ROGAN
*Director of the United States Patent and Trademark Office*

(12) United States Patent
Imkamp et al.

(10) Patent No.: US 6,092,351 B1
(45) Date of Patent: Jul. 25, 2000

(54) METHOD AND DEVICE FOR BONDING POURERS TO FLAT-TOPPED PARALLELEPIDAL CARTONS FILLED WITH FREE-FLOWING PRODUCTS

(75) Inventors: Thomas Imkamp, Dusseldorf; Hans Peter Lonzen, Eschweiler; Peter Meyer, Beringen, all of (DE)

(73) Assignee: SIG Combibloc, GmbH (DE)

( * ) Notice: Subject to any disclaimer, the term of this patent is extended or adjusted under 35 U.S.C. 154(b) by 0 days.

(21) Appl. No.: 09/011,168

(22) PCT Filed: Jul. 27, 1996

(86) PCT No.: PCT/EP96/03322

§ 371 Date: Apr. 14, 1998

§ 102(e) Date: Apr. 14, 1998

(87) PCT Pub. No.: WO97/04953

PCT Pub. Date: Feb. 13, 1997

(30) Foreign Application Priority Data

Aug. 2, 1995 (DE) ..... 195 28 367

(51) Int. Cl.[6] ..... B65B 61/18

(52) U.S. Cl. ..... 53/412; 53/69; 53/72; 53/133.2; 53/133.4; 53/410; 493/87

(58) Field of Search ..... 156/69; 493/8, 493/12, 27, 29, 87, 102, 213, 214; 53/64, 67, 69, 72, 410, 412, 133.1, 133.2, 133.3, 133.4

(56) References Cited

U.S. PATENT DOCUMENTS 4,507,168 A * 3/1985 Konaka ..... 493/133 X
4,788,811 A * 12/1988 Kawajiri et al. ..... 493/87 X
4,990,200 A * 2/1991 Heinz ..... 53/485 X
5,219,320 A * 6/1993 Abrams et al. ..... 493/87 X
5,297,375 A * 3/1994 Reil et al. ..... 53/133.2 X
5,304,265 A * 4/1994 Keeler ..... 156/64
5,429,699 A * 7/1995 Abrams et al. ..... 493/87 X
5,447,007 A * 9/1995 Reil et al. ..... 53/133.2
5,473,857 A * 12/1995 Keeler ..... 53/133.2 X
5,484,374 A * 1/1996 Bachner et al. ..... 53/133.2 X
5,716,471 A * 2/1998 Pape ..... 53/410 X

FOREIGN PATENT DOCUMENTS

EP 0 513 439 11/1992
JP 04 112030 8/1992

* cited by examiner

*Primary Examiner*—Daniel B. Moon
(74) *Attorney, Agent, or Firm*—Standley & Gilcrest LLP

(57) ABSTRACT

A method and apparatus for applying pouring elements to flat-gabled packages filled with free-flowing products, wherein the pouring elements are glued to the individually conveyed and sealed packages through a fully-automatic application operation, and whereby problems due to improper positioning and incomplete gluing of the pouring elements is reliably prevented. In addition, packages may be prevented from leaving the application station without a properly applied pouring element. The packages are horizontally conveyed in succession and in an essentially upright position. The packages are then separated and introduced into an application station as dictated by the presence of a pouring element. Adhesive is applied to the pouring element, and the pouring element is pressed and applied to a predetermined area of the package by a pouring element carrier attached to a carrying chain and traveling above the package.

16 Claims, 5 Drawing Sheets

METHOD AND DEVICE FOR BONDING POURERS TO FLAT-TOPPED PARALLELEPIDAL CARTONS FILLED WITH FREE-FLOWING PRODUCTS

BACKGROUND AND SUMMARY OF THE INVENTION

The invention relates generally to a method of machine application of pouring elements to cuboid flat-gabled packages filled with free-flowing products, where the pouring elements are glued to the individually supplied and sealed packages, and also to an apparatus suitable for applying said pouring elements. The invention contemplates the use of conveyance equipment for conveying the packages and pouring elements, and also an application station where the pouring elements are affixed to the packages.

Generally, cuboid flat-gabled packages are most commonly seen as retail units for beverages. Depending on the size and contents of these packages, it is often desirous to provide a re-closeable pour spout. There are several benefits to employing a re-closeable pour spout, including preventing contamination (hygiene), extending shelf life (freshness), and preventing loss of taste or aroma. A previously described flat-gabled package having such a re-closable pour spout is known, for example, from European Patent 332,800 B1 or World Patent WO 92/18394. With the previously known art, the pouring element is generally applied to the package after the package has been filled and sealed. Therefore, the top side of the package commonly has a perforation in the laminated material to facilitate the penetration of the package by the opening part of the pouring element during the actual operation of opening the package. In such case, the pouring element must be applied to the top side of the package exactly above the perforation.

If pouring element application is to take place as above described, it can be seen that affixing the pouring elements to the packages must be done very carefully to attain the proper position, as well as to achieve reliable bonding. Reliable bonding is critical to prevent the pouring element from pulling away from the package, and to ensure that no leaks occur after opening.

U.S. Pat. No. 5,219,320 discloses a method and an apparatus for machine application of pouring elements, where the pouring elements are applied before filling the packages. For the actual application, a predetermined amount of adhesive is applied to the package and then the pouring element is glued on. This method of applying pouring elements is not free of drawbacks, however, because the pouring elements must be applied through an opening previously punched through the wall of the package. Due to the punching and application procedures, a considerable effort must be expended in order to clean and sterilize the package prior to filling, especially in the area of the pouring element. This is required to safely rule out the possibility of dust or adhesive coming in contact with the product enclosed in the package.

Therefore, one aspect of the invention is to improve on the method and apparatus so that fully automatic application of the pouring elements is possible, while at the same time reliably preventing problems due to improper positioning and incomplete gluing. In addition, it is desirable to prevent packages from leaving the application station without the pouring element sealed in place.

This object is achieved by the following steps with regard to the method according to the present invention: horizontally conveying a succession of upright packages; isolating the packages by braking and then accelerating the packages; introducing the isolated packages into an application station which can move along the conveyance pathway, depending on the presence of a pouring element; applying adhesive to the pouring element; and gluing and pressing the pouring element to a predetermined area of each package.

The horizontally conveyed packages are preferably arranged in succession, in an upright position. Hot-melt adhesive is preferably used for gluing the pouring elements to the packages.

With regard to the respective apparatus, a horizontally moving conveyor chain is used to guide the packages at the their bottoms. A separator isolates the packages, and an entraining element with a number of spaced driving elements is provided for further conveying the isolated packages. A carrying chain with a number of carriers for the pouring elements is arranged above the entraining element, with their spacing corresponding to the spacing between the driving elements arranged on the entraining element. There is preferably an applicator element residing in the application station portion of the apparatus for applying the adhesive to the pouring elements, as well as a detector for detecting the presence of a pouring element in the pouring element carriers therein conveyed.

According to this invention, a package is always cycled into the entraining element when a pouring element is "waiting" in the transfer position. This reliably ensures that a package also leaves the application station with a properly applied pouring element. The packages leaving the application station can thus be packaged fully automatically without sorting-out packages that do not have a pouring element. Additionally, because the amount of hot-melt adhesive applied to the pouring elements is metered according to the present invention, the need to interrupt production in order to clean up excessive or improperly applied hot-melt adhesive is eliminated.

In a preferred embodiment of the invention, the separator has a brake unit for stopping the conveyed packages on the moving conveyor chain and an acceleration unit for accelerating the conveyed packages onto the moving entraining element. This design provides the advantage that the conveyor chain guiding the packages at the bottom can continue to run at the same speed, thereby allowing further conveyance of the packages toward the front of the conveyor chain even when the brake unit is operated. At least two conveyor belts that act on the side walls of several adjacent packages can be provided as the brake unit. In this design, the brake unit not only has the function of braking the packages but also serves as a side guide. When the brake unit is not operated, this embodiment allows the brake unit to serve as a conveyance device that can be driven at the same rate of conveyance as the conveyor chain, thereby providing gentle conveyance of the packages.

According to another aspect of the present invention, a pair of vertically arranged separating rolls is provided as the acceleration unit. In this way, it is possible at a low construction expense to accelerate the neighboring packages on the conveyor chain to the conveyance speed of the entraining element and thus separate them.

According to the present invention, at least one entraining belt producing forced feed of the packages through contact with their back surfaces by means of projecting fingers may be provided as the entraining element. It is clear that an entraining chain or similar device may also be used within the scope of this invention.

It is especially expedient if the conveyance speed of the entraining element is greater than the conveyance speed of the conveyor chain, and also if the conveyance speed of the acceleration unit is greater than the conveyance speed of the brake unit. Therefore, the brake unit need be activated only when no pouring element is being supplied.

As mentioned previously, the pouring elements, conveyed individually and taken up by the pouring element carriers with their bottom side (adhesive side) facing up, are conveyed to the packages from above in the gluing station.

In a preferred embodiment of the invention, each pouring element carrier has two clamps that can be spread apart against a spring force to hold and release the pouring element. In addition, each pouring element carrier may have at least one pressure element for gently pressing the pouring element against the top side of the already sealed package, immediately after application, and prior to release of the pouring element.

The pouring elements coming from the known isolation and aligning unit are not coated with the proper amount of adhesive until shortly before being brought in contact with the package. In a preferred embodiment of this invention, a known applicator roll is used for this purpose.

Preferably, the separator, the entraining element, and the conveyor chain or carrying chain are designed to be adjustable in their geometric dimensions to allow for application of pouring elements onto packages of different sizes. Thus, with a single apparatus according to this invention, numerous different package sizes can be provided with pouring elements. It is especially advantageous here if two entraining belts which are arranged one above the other, and are designed to be adjustable in height relative to each other, are used as the entraining element.

Another teaching of this invention provides for the individual treatment units through which the packages pass to be arranged in a straight line one after the other. In this way, the size of the apparatus according to the present invention can be reduced, and can optionally also be used with filling machines employing multiple parallel packaging lines directly side by side with other apparatus of the same type.

BRIEF DESCRIPTION OF THE DRAWINGS

In addition to the novel features and advantages mentioned above, other objects and advantages of the present invention will be readily apparent from the following descriptions of the drawings and preferred embodiments, wherein.

DETAILED DESCRIPTION OF PREFERRED EMBODIMENT(S)

Figure 1:
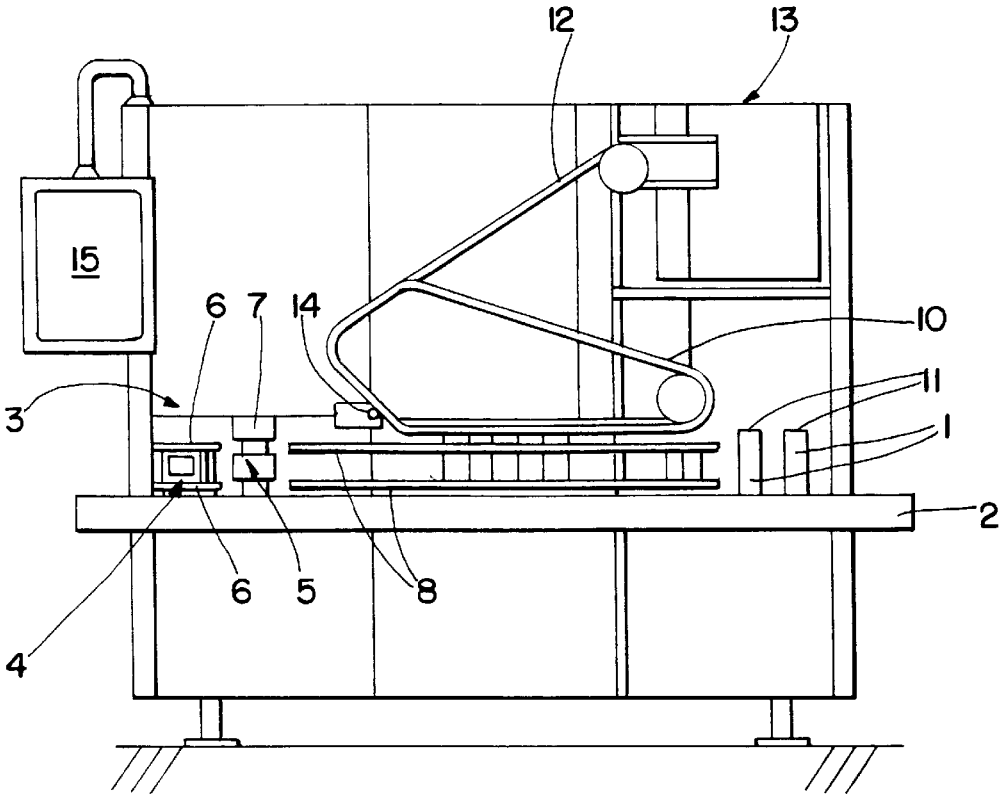
FIG. 1 is a side view of an apparatus according to a preferred embodiment of the present invention.
Figure 2:
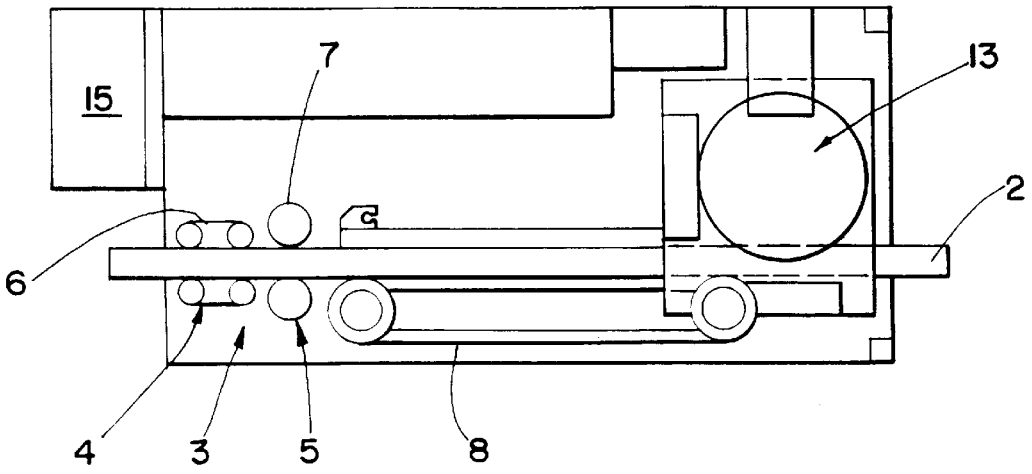
FIG. 2 is a top view of the apparatus according to a preferred embodiment of the present invention.

FIGS. 1 and 2 show the general design of the apparatus according to a preferred embodiment of the present invention. Packages 1 are conveyed on a conveyor chain 2 to a separator 3 consisting of a brake unit 4 and an acceleration unit 5.

Figure 4:
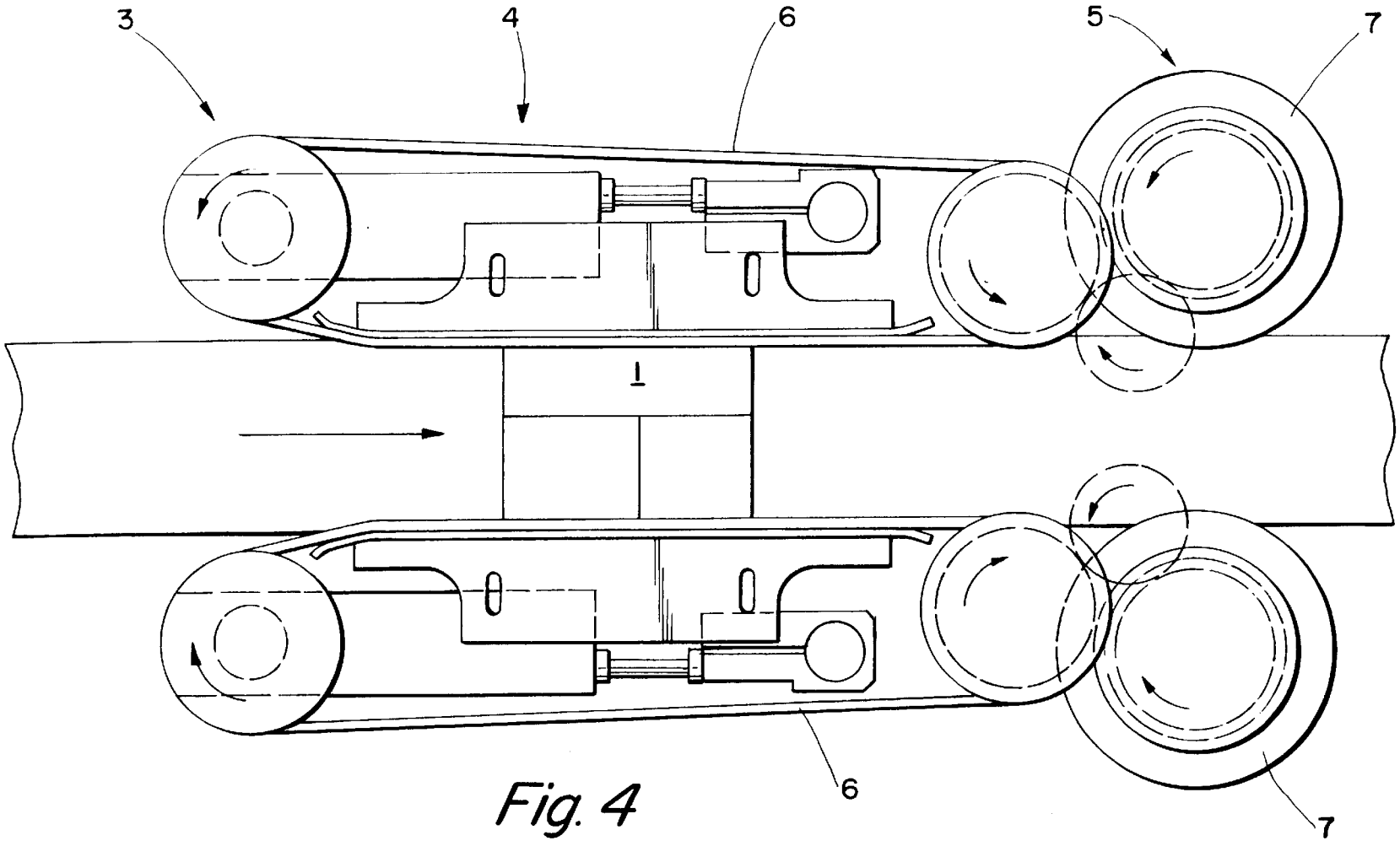
FIG. 4 is a detailed view of a separator according to a preferred embodiment of the apparatus of the present invention, wherein the separator consists of a brake unit and an acceleration unit.

The brake unit 4 consists essentially of conveyor belts 6, which are guided around rolls and come in contact with the packages 1 from both sides, and the acceleration unit 5 consists of two vertically arranged pairs 7 of separation rolls adapted to the width of the package. The exact arrangement of the separator 3 is shown in greater detail in FIG. 4. In FIG. 4, it can be seen that the packages 1 are supported in the area of conveyor belts 6 by supporting plates (not shown), which reside between the conveyor belt rolls.

Figure 3:
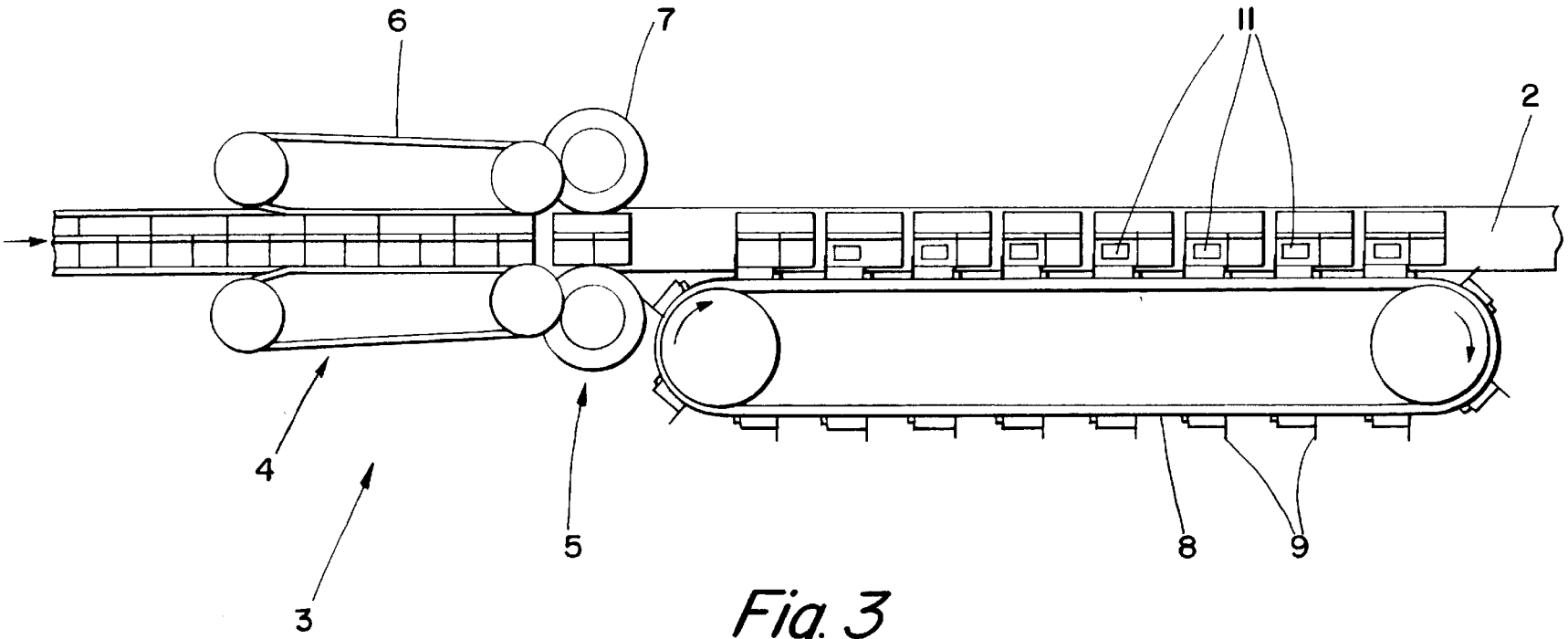
FIG. 3 illustrates a detailed view of the apparatus according to the preferred embodiment of the present invention shown in FIG. 2.

The actual treatment sequence can be described best by reference to FIG. 3. Packages 1-1 to 1-6 from the brake unit 4 are shown in the "stopped" position on conveyor chain 2, which is moving in the direction of the arrow. When a package 1-7 leaves brake unit 4, it is accelerated by the separating rolls 7 of the acceleration unit 5 so that it is conveyed into the proper position within two entraining fingers 9 located on the belt 8 of the entraining element (shown here in mirror image). In the preferred embodiment shown in FIG. 3, the driving rolls of the brake unit's conveyor belts 6 and those of the acceleration unit's separating rolls 7 are connected together effectively by means of inter-meshing gearwheels (not shown in detail). The greater peripheral speed of the separating rolls 7 in comparison with the conveyor belt rolls is achieved by employing a larger outside diameter on the separating rolls. This speed difference is necessary to achieve separation of the packages 1. The spacing between the entraining fingers 9 corresponds substantially to the spacing between two adjacent pouring element carriers (not shown in FIGS. 1 through 3), which are described in greater detail below.

FIG. 1 also illustrates that a carrying chain 10, to which the above-mentioned pouring element carriers are attached, is arranged above the entraining belts 8 in the application station. The carrying chain 10 serves to hold and convey pouring elements 11, which are conveyed to the pouring element carriers by a rail-like pouring element conveyance 12 from a separating and aligning unit 13. Such separating and aligning units are well known, and therefore merely indicated as to position without an accompanying detailed description. The pouring elements 11 are then coated with the required amount of adhesive by an applicator roll 14, which is also known, and glued to the packages 1 in the proper position. An adhesive supply 15 is preferably provided to furnish the applicator roller 14 with adhesive.

Figure 6:
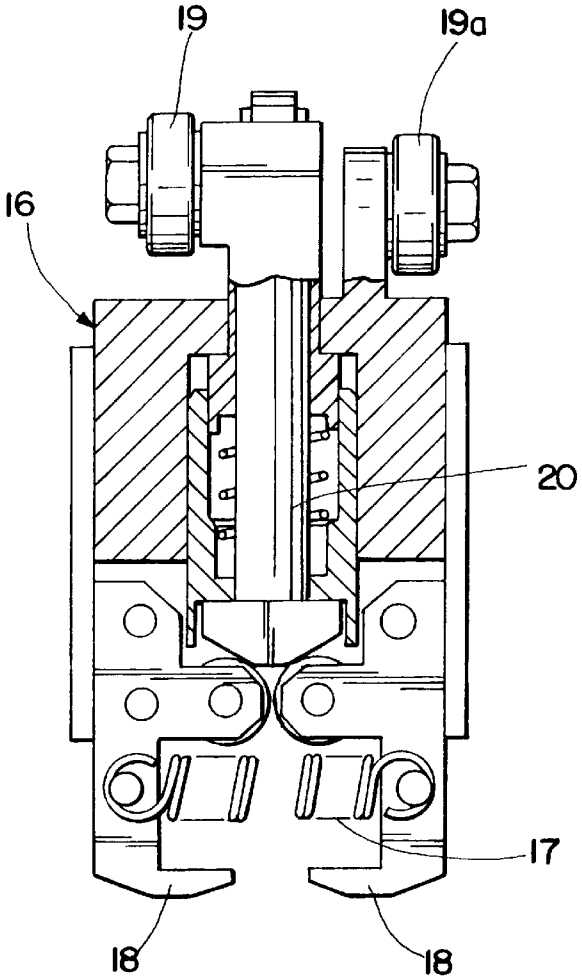
FIG. 6 shows a sectional view along line VI—VI of the pouring element carrier depicted in FIG. 5.
Figure 5:
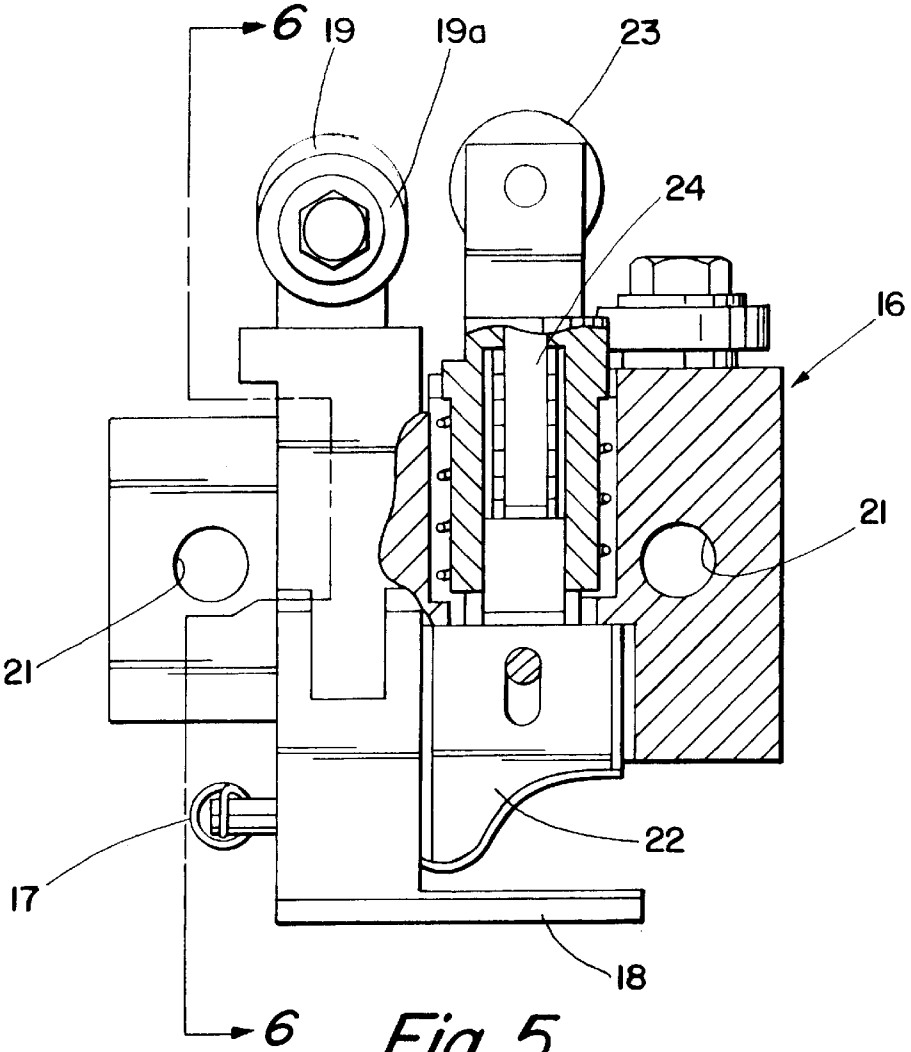
FIG. 5 is a cross-sectional view of a pouring element carrier according to a preferred embodiment of the apparatus of the present invention.

FIGS. 5 and 6 show the pouring element carriers 16 in detail. The pouring elements 11 (not shown) are held by spreading clamps 18 which act against the force of a spring 17. The spreading clamps 18 are operated by a pressure element 20, which is also spring-loaded and is in turn operated by a roller 19. The pouring element carriers 16 are lowered by rollers 19*a*, which are rigidly connected thereto. Preferably, the pouring element carriers 16 are movably attached to the carrying chain 10 by means of bolts (not shown) through two boreholes 21.

During the application process, the pouring elements 11 are pressed against the top side of the packages 1 by a pressure pin 22, which is present in each pouring element carrier 16. The spreading clamps 18 are spread apart to release the pouring elements 11. Pressure pins 22 are also spring-loaded and are activated by a pressure element 24 activated by a roller 23.

Figure 7:
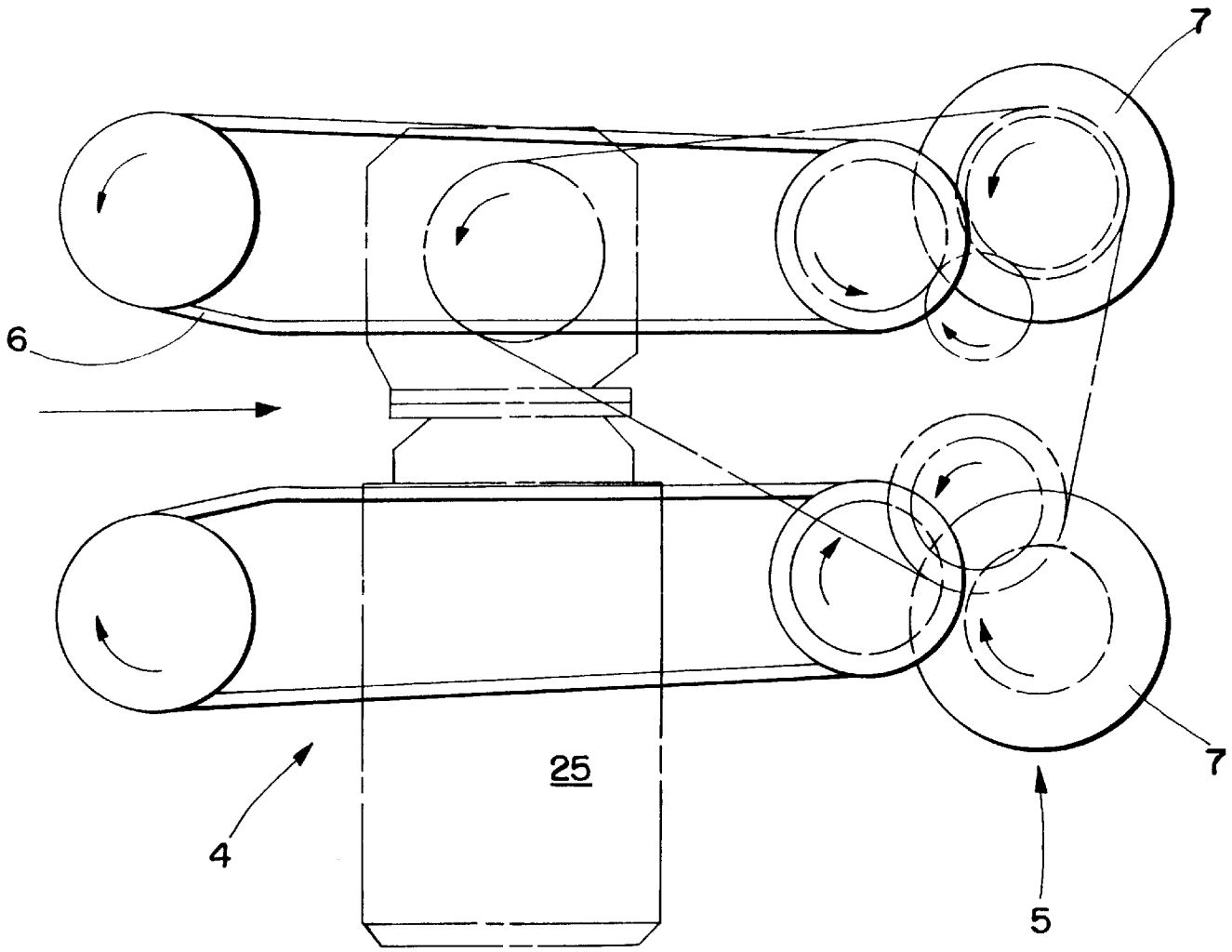
FIG. 7 is a preferred driving diagram of the apparatus according to a preferred embodiment of the present invention.

Finally, FIG. 7 is a preferred drive diagram, illustrating that the speed of conveyance of the separating rolls 7 that form the acceleration unit 5 is greater than the conveyance speed of the conveyor belts which form brake unit 4 and are driven by the same drive 25.

What is claimed is:

1. A method of machine application of pouring elements to flat-gabled packages filled with free-flowing products, where the pouring elements are glued to individually conveyed and sealed packages, said method comprising the steps of:

horizontally conveying a successive arrangement of packages in an upright orientation;

isolating said packages by braking and then accelerating said packages;

introducing said isolated packages into an application station adapted to move along the conveyance path if a pouring element is present;

applying an adhesive to said pouring element; and gluing and pressing said pouring element to a predetermined area of each package, while said package continues to move along said conveyance path.

2. The method of claim 1, wherein said horizontally conveyed packages are successively arranged in a longitudinal direction.

3. The method of claim 1, wherein said adhesive is of a hot-melt variety.

4. A device for applying pouring elements to flat-gabled packages filled with free-flowing products, said device comprising:

a horizontally moving conveyor chain for guiding said packages;

a separator for isolating said packages;

an entraining element having a number of spaced driving elements for conveying said isolated packages;

a carrying chain disposed above said entraining element a number of spaced pouring element carriers attached to said carrying chain, the spacing of said pouring element carriers on said carrying chain corresponding to the spacing between said driving elements on said entraining element, said pouring element carriers adapted to apply said pouring elements to said packages while said packages remain in motion on said entraining element; and a gluing station having a detector for determining the presence of a pouring element within any of said pouring element carriers, and an applicator for applying an adhesive to said pouring element if present.

5. The device of claim 4, further comprising a brake unit for stopping the conveyed packages on the moving conveyor chain, and an acceleration unit for accelerating said conveyed packages on the moving conveyor chain.

6. The device of claim 5, wherein said brake unit comprises at least two conveyor belts for acting on the side walls of several adjacent packages.

7. The device of claim 5, wherein said acceleratiòn unit comprises at least one pair of vertically arranged separating rolls.

8. The device of claim 5, wherein the conveyance speed of said acceleration unit is greater than the conveyance speed of said brake unit.

9. The device of claim 5 wherein said brake unit, said acceleration unit and said entraining element are arranged in a straight line.

10. The device of claim 4, wherein said entraining element comprises at least one belt having driving elements comprising projecting fingers, said fingers designed to convey said packages by contact with said package rear sides.

11. The device of claim 4, wherein the conveyance speed of said entraining element is greater than the conveyance speed of said conveyor chain.

12. The device of claim 4 wherein each pouring element carrier has at least two clamps that can be spread against a spring force to hold and release said pouring element.

13. The device of claim 4 wherein each pouring element carrier has at least one pressure element for pressing the pouring element against the top of said package.

14. The device of claim 4 wherein an applicator roll is provided for applying an adhesive to said pouring elements.

15. The device of claim 4 wherein said separator, said entraining element, and said conveyor chain or said carrying chain are adjustable, so that said device can apply pouring elements to packages of different size.

16. The device of claim 4 wherein said entraining element comprises two belts arranged one above the other, said belts designed to be adjustable in height relative to one another.

* * * * *

UNITED STATES PATENT AND TRADEMARK OFFICE

CERTIFICATE OF CORRECTION

PATENT NO. : 6,092,351 
DATED : July 25, 2000
INVENTOR(S) : Thomas Imkamp, Hans Peter Lonzen and Peter Meyer It is certified that error appears in the above-identified patent and that said Letters Patent is hereby corrected as shown below:

Delete the entire specification, claims and abstract and substitute with the attached specification, claims and abstract.

Signed and Sealed this

Twenty-ninth Day of October, 2002

*Attest:*

*Attesting Officer*

JAMES E. ROGAN
*Director of the United States Patent and Trademark Office*

(12) United States Patent
Imkamp et al.

(10) Patent No.: US 6,092,351 B1
(45) Date of Patent: Jul. 25, 2000

(54) METHOD AND DEVICE FOR BONDING POURERS TO FLAT-TOPPED PARALLELEPIDAL CARTONS FILLED WITH FREE-FLOWING PRODUCTS

(75) Inventors: Thomas Imkamp, Dusseldorf; Hans Peter Lonzen, Eschweiler; Peter Meyer, Beringen, all of (DE)

(73) Assignee: SIG Combibloc, GmbH (DE)

( * ) Notice: Subject to any disclaimer, the term of this patent is extended or adjusted under 35 U.S.C. 154(b) by 0 days.

(21) Appl. No.: 09/011,168

(22) PCT Filed: Jul. 27, 1996

(86) PCT No.: PCT/EP96/03322

§ 371 Date: Apr. 14, 1998

§ 102(e) Date: Apr. 14, 1998

(87) PCT Pub. No.: WO97/04953

PCT Pub. Date: Feb. 13, 1997

(30) Foreign Application Priority Data

Aug. 2, 1995 (DE) ..... 195 28 367

(51) Int. Cl.[6] ..... B65B 61/18

(52) U.S. Cl. ..... 53/412; 53/69; 53/72; 53/133.2; 53/133.4; 53/410; 493/87

(58) Field of Search ..... 156/69; 493/8, 493/12, 27, 29, 87, 102, 213, 214; 53/64, 67, 69, 72, 410, 412, 133.1, 133.2, 133.3, 133.4

(56) References Cited

U.S. PATENT DOCUMENTS 4,507,168 A * 3/1985 Konaka ..... 493/133 X
4,788,811 A * 12/1988 Kawajiri et al. ..... 493/87 X
4,990,200 A * 2/1991 Heinz ..... 53/485 X
5,219,320 A * 6/1993 Abrams et al. ..... 493/87 X
5,297,375 A * 3/1994 Reil et al. ..... 53/133.2 X
5,304,265 A * 4/1994 Keeler ..... 156/64
5,429,699 A * 7/1995 Abrams et al. ..... 493/87 X
5,447,007 A * 9/1995 Reil et al. ..... 53/133.2
5,473,857 A * 12/1995 Keeler ..... 53/133.2 X
5,484,374 A * 1/1996 Bachner et al. ..... 53/133.2 X
5,716,471 A * 2/1998 Pape ..... 53/410 X

FOREIGN PATENT DOCUMENTS

| | | |
|---|---|---|
| EP | 0 513 439 | 11/1992 |
| JP | 04 112030 | 8/1992 |

* cited by examiner

*Primary Examiner*—Daniel B. Moon
(74) *Attorney, Agent, or Firm*—Standley & Gilcrest LLP

(57) ABSTRACT

A method and apparatus for applying pouring elements to flat-gabled packages filled with free-flowing products, wherein the pouring elements are glued to the individually conveyed and sealed packages through a fully-automatic application operation, and whereby problems due to improper positioning and incomplete gluing of the pouring elements is reliably prevented. In addition, packages may be prevented from leaving the application station without a properly applied pouring element. The packages are horizontally conveyed in succession and in an essentially upright position. The packages are then separated and introduced into an application station as dictated by the presence of a pouring element. Adhesive is applied to the pouring element, and the pouring element is pressed and applied to a predetermined area of the package by a pouring element carrier attached to a carrying chain and traveling above the package.

16 Claims, 5 Drawing Sheets

METHOD AND DEVICE FOR BONDING POURERS TO FLAT-TOPPED PARALLELEPIDAL CARTONS FILLED WITH FREE-FLOWING PRODUCTS

BACKGROUND AND SUMMARY OF THE INVENTION

The invention relates generally to a method of machine application of pouring elements to cuboid flat-gabled packages filled with free-flowing products, where the pouring elements are glued to the individually supplied and sealed packages, and also to an apparatus suitable for applying said pouring elements. The invention contemplates the use of conveyance equipment for conveying the packages and pouring elements, and also an application station where the pouring elements are affixed to the packages.

Generally, cuboid flat-gabled packages are most commonly seen as retail units for beverages. Depending on the size and contents of these packages, it is often desirous to provide a re-closeable pour spout. There are several benefits to employing a re-closeable pour spout, including preventing contamination (hygiene), extending shelf life (freshness), and preventing loss of taste or aroma. A previously described flat-gabled package having such a re-closable pour spout is known, for example, from European Patent 332,800 B1 or World Patent WO 92/18394. With the previously known art, the pouring element is generally applied to the package after the package has been filled and sealed. Therefore, the top side of the package commonly has a perforation in the laminated material to facilitate the penetration of the package by the opening part of the pouring element during the actual operation of opening the package. In such case, the pouring element must be applied to the top side of the package exactly above the perforation.

If pouring element application is to take place as above described, it can be seen that affixing the pouring elements to the packages must be done very carefully to attain the proper position, as well as to achieve reliable bonding. Reliable bonding is critical to prevent the pouring element from pulling away from the package, and to ensure that no leaks occur after opening.

U.S. Pat. No. 5,219,320 discloses a method and an apparatus for machine application of pouring elements, where the pouring elements are applied before filling the packages. For the actual application, a predetermined amount of adhesive is applied to the package and then the pouring element is glued on. This method of applying pouring elements is not free of drawbacks, however, because the pouring elements must be applied through an opening previously punched through the wall of the package. Due to the punching and application procedures, a considerable effort must be expended in order to clean and sterilize the package prior to filling, especially in the area of the pouring element. This is required to safely rule out the possibility of dust or adhesive coming in contact with the product enclosed in the package.

Therefore, one aspect of the invention is to improve on the method and apparatus so that fully automatic application of the pouring elements is possible, while at the same time reliably preventing problems due to improper positioning and incomplete gluing. In addition, it is desirable to prevent packages from leaving the application station without the pouring element sealed in place.

This object is achieved by the following steps with regard to the method according to the present invention: horizontally conveying a succession of upright packages; isolating the packages by braking and then accelerating the packages; introducing the isolated packages into an application station which can move along the conveyance pathway, depending on the presence of a pouring element; applying adhesive to the pouring element; and gluing and pressing the pouring element to a predetermined area of each package.

The horizontally conveyed packages are preferably arranged in succession, in an upright position. Hot-melt adhesive is preferably used for gluing the pouring elements to the packages.

With regard to the respective apparatus, a horizontally moving conveyor chain is used to guide the packages at the their bottoms. A separator isolates the packages, and an entraining element with a number of spaced driving elements is provided for further conveying the isolated packages. A carrying chain with a number of carriers for the pouring elements is arranged above the entraining element, with their spacing corresponding to the spacing between the driving elements arranged on the entraining element. There is preferably an applicator element residing in the application station portion of the apparatus for applying the adhesive to the pouring elements, as well as a detector for detecting the presence of a pouring element in the pouring element carriers therein conveyed.

According to this invention, a package is always cycled into the entraining element when a pouring element is "waiting" in the transfer position. This reliably ensures that a package also leaves the application station with a properly applied pouring element. The packages leaving the application station can thus be packaged fully automatically without sorting-out packages that do not have a pouring element. Additionally, because the amount of hot-melt adhesive applied to the pouring elements is metered according to the present invention, the need to interrupt production in order to clean up excessive or improperly applied hot-melt adhesive is eliminated.

In a preferred embodiment of the invention, the separator has a brake unit for stopping the conveyed packages on the moving conveyor chain and an acceleration unit for accelerating the conveyed packages onto the moving entraining element. This design provides the advantage that the conveyor chain guiding the packages at the bottom can continue to run at the same speed, thereby allowing further conveyance of the packages toward the front of the conveyor chain even when the brake unit is operated. At least two conveyor belts that act on the side walls of several adjacent packages can be provided as the brake unit. In this design, the brake unit not only has the function of braking the packages but also serves as a side guide. When the brake unit is not operated, this embodiment allows the brake unit to serve as a conveyance device that can be driven at the same rate of conveyance as the conveyor chain, thereby providing gentle conveyance of the packages.

According to another aspect of the present invention, a pair of vertically arranged separating rolls is provided as the acceleration unit. In this way, it is possible at a low construction expense to accelerate the neighboring packages on the conveyor chain to the conveyance speed of the entraining element and thus separate them.

According to the present invention, at least one entraining belt producing forced feed of the packages through contact with their back surfaces by means of projecting fingers may be provided as the entraining element. It is clear that an entraining chain or similar device may also be used within the scope of this invention.

It is especially expedient if the conveyance speed of the entraining element is greater than the conveyance speed of the conveyor chain, and also if the conveyance speed of the acceleration unit is greater than the conveyance speed of the brake unit. Therefore, the brake unit need be activated only when no pouring element is being supplied.

As mentioned previously, the pouring elements, conveyed individually and taken up by the pouring element carriers with their bottom side (adhesive side) facing up, are conveyed to the packages from above in the gluing station.

In a preferred embodiment of the invention, each pouring element carrier has two clamps that can be spread apart against a spring force to hold and release the pouring element. In addition, each pouring element carrier may have at least one pressure element for gently pressing the pouring element against the top side of the already sealed package, immediately after application, and prior to release of the pouring element.

The pouring elements coming from the known isolation and aligning unit are not coated with the proper amount of adhesive until shortly before being brought in contact with the package. In a preferred embodiment of this invention, a known applicator roll is used for this purpose.

Preferably, the separator, the entraining element, and the conveyor chain or carrying chain are designed to be adjustable in their geometric dimensions to allow for application of pouring elements onto packages of different sizes. Thus, with a single apparatus according to this invention, numerous different package sizes can be provided with pouring elements. It is especially advantageous here if two entraining belts which are arranged one above the other, and are designed to be adjustable in height relative to each other, are used as the entraining element.

Another teaching of this invention provides for the individual treatment units through which the packages pass to be arranged in a straight line one after the other. In this way, the size of the apparatus according to the present invention can be reduced, and can optionally also be used with filling machines employing multiple parallel packaging lines directly side by side with other apparatus of the same type.

BRIEF DESCRIPTION OF THE DRAWINGS

In addition to the novel features and advantages mentioned above, other objects and advantages of the present invention will be readily apparent from the following descriptions of the drawings and preferred embodiments, wherein:

FIG. 1 is a side view of an apparatus according to a preferred embodiment of the present invention;

FIG. 2 is a top view of the apparatus according to a preferred embodiment of the present invention;

FIG. 3 illustrates a detailed view of the apparatus according to the preferred embodiment of the present invention shown in FIG. 2;

FIG. 4 is a detailed view of a separator according to a preferred embodiment of the apparatus of the present invention, wherein the separator consists of a brake unit and an acceleration unit;

FIG. 5 is a cross-sectional view of a pouring element carrier according to a preferred embodiment of the apparatus of the present invention;

FIG. 6 shows a sectional view along line VI—VI of the pouring element carrier depicted in FIG. 5; and FIG. 7 is a preferred driving diagram of the apparatus according to a preferred embodiment of the present invention.

DETAILED DESCRIPTION OF PREFERRED EMBODIMENT(S)

FIGS. 1 and 2 show the general design of the apparatus according to a preferred embodiment of the present invention. Packages 1 are conveyed on a conveyor chain 2 to a separator 3 consisting of a brake unit 4 and an acceleration unit 5.

The brake unit 4 consists essentially of conveyor belts 6, which are guided around rolls and come in contact with the packages 1 from both sides, and the acceleration unit 5 consists of two vertically arranged pairs 7 of separation rolls adapted to the width of the package. The exact arrangement of the separator 3 is shown in greater detail in FIG. 4. In FIG. 4, it can be seen that the packages 1 are supported in the area of conveyor belts 6 by supporting plates (not shown), which reside between the conveyor belt rolls.

The actual treatment sequence can be described best by reference to FIG. 3. Packages 1-1 to 1-6 from the brake unit 4 are shown in the "stopped" position on conveyor chain 2, which is moving in the direction of the arrow. When a package 1-7 leaves brake unit 4, it is accelerated by the separating rolls 7 of the acceleration unit 5 so that it is conveyed into the proper position within two entraining fingers 9 located on the belt 8 of the entraining element (shown here in mirror image). In the preferred embodiment shown in FIG. 3, the driving rolls of the brake unit's conveyor belts 6 and those of the acceleration unit's separating rolls 7 are connected together effectively by means of inter-meshing gearwheels (not shown in detail). The greater peripheral speed of the separating rolls 7 in comparison with the conveyor belt rolls is achieved by employing a larger outside diameter on the separating rolls. This speed difference is necessary to achieve separation of the packages 1. The spacing between the entraining fingers 9 corresponds substantially to the spacing between two adjacent pouring element carriers (not shown in FIGS. 1 through 3), which are described in greater detail below.

FIG. 1 also illustrates that a carrying chain 10, to which the above-mentioned pouring element carriers are attached, is arranged above the entraining belts 8 in the application station. The carrying chain 10 serves to hold and convey pouring elements 11, which are conveyed to the pouring element carriers by a rail-like pouring element conveyance 12 from a separating and aligning unit 13. Such separating and aligning units are well known, and therefore merely indicated as to position without an accompanying detailed description. The pouring elements 11 are then coated with the required amount of adhesive by an applicator roll 14, which is also known, and glued to the packages 1 in the proper position. An adhesive supply 15 is preferably provided to furnish the applicator roller 14 with adhesive.

FIGS. 5 and 6 show the pouring element carriers 16 in detail. The pouring elements 11 (not shown) are held by spreading clamps 18 which act against the force of a spring 17. The spreading clamps 18 are operated by a pressure element 20, which is also spring-loaded and is in turn operated by a roller 19. The pouring element carriers 16 are lowered by rollers 19*a*, which are rigidly connected thereto. Preferably, the pouring element carriers 16 are movably attached to the carrying chain 10 by means of bolts (not shown) through two boreholes 21.

During the application process, the pouring elements 11 are pressed against the top side of the packages 1 by a pressure pin 22, which is present in each pouring element carrier 16. The spreading clamps 18 are spread apart to release the pouring elements 11. Pressure pins 22 are also spring-loaded and are activated by a pressure element 24 activated by a roller 23.

Finally, FIG. 7 is a preferred drive diagram, illustrating that the speed of conveyance of the separating rolls 7 that form the acceleration unit 5 is greater than the conveyance speed of the conveyor belts which form brake unit 4 and are driven by the same drive 25.

What is claimed is:

1. A method of machine application of pouring elements to flat-gabled packages filled with free-flowing products, where the pouring elements are glued to individually conveyed and sealed packages, said method comprising the steps of:

horizontally conveying a successive arrangement of packages in an upright orientation;

isolating said packages by braking and then accelerating said packages;

introducing said isolated packages into an application station adapted to move along the conveyance path if a pouring element is present;

applying an adhesive to said pouring element; and gluing and pressing said pouring element to a predetermined area of each package, while said package continues to move along said conveyance path.

2. The method of claim 1, wherein said horizontally conveyed packages are successively arranged in a longitudinal direction.

3. The method of claim 1, wherein said adhesive is of a hot-melt variety.

4. A device for applying pouring elements to flat-gabled packages filled with free-flowing products, said device comprising:

a horizontally moving conveyor chain for guiding said packages;

a separator for isolating said packages;

an entraining element having a number of spaced driving elements for conveying said isolated packages;

a carrying chain disposed above said entraining element a number of spaced pouring element carriers attached to said carrying chain, the spacing of said pouring element carriers on said carrying chain corresponding to the spacing between said driving elements on said entraining element, said pouring element carriers adapted to apply said pouring elements to said packages while said packages remain in motion on said entraining element; and a gluing station having a detector for determining the presence of a pouring element within any of said pouring element carriers, and an applicator for applying an adhesive to said pouring element if present.

5. The device of claim 4, further comprising a brake unit for stopping the conveyed packages on the moving conveyor chain, and an acceleration unit for accelerating said conveyed packages on the moving conveyor chain.

6. The device of claim 5, wherein said brake unit comprises at least two conveyor belts for acting on the side walls of several adjacent packages.

7. The device of claim 5, wherein said acceleration unit comprises at least one pair of vertically arranged separating rolls.

8. The device of claim 5, wherein the conveyance speed of said acceleration unit is greater than the conveyance speed of said brake unit.

9. The device of claim 5 wherein said brake unit, said acceleration unit and said entraining element are arranged in a straight line.

10. The device of claim 4, wherein said entraining element comprises at least one belt having driving elements comprising projecting fingers, said fingers designed to convey said packages by contact with said package rear sides.

11. The device of claim 4, wherein the conveyance speed of said entraining element is greater than the conveyance speed of said conveyor chain.

12. The device of claim 4 wherein each pouring element carrier has at least two clamps that can be spread against a spring force to hold and release said pouring element.

13. The device of claim 4 wherein each pouring element carrier has at least one pressure element for pressing the pouring element against the top of said package.

14. The device of claim 4 wherein an applicator roll is provided for applying an adhesive to said pouring elements.

15. The device of claim 4 wherein said separator, said entraining element, and said conveyor chain or said carrying chain are adjustable, so that said device can apply pouring elements to packages of different size.

16. The device of claim 4 wherein said entraining element comprises two belts arranged one above the other, said belts designed to be adjustable in height relative to one another.

* * * * *